US007722114B2

(12) United States Patent
Smith

(10) Patent No.: US 7,722,114 B2
(45) Date of Patent: May 25, 2010

(54) ZERO GRAVITY WALL HUGGER RECLINER

(75) Inventor: Nathaniel Smith, Holliston, MA (US)

(73) Assignee: Jobri LLC, Konawa, OK (US)

( * ) Notice: Subject to any disclaimer, the term of this patent is extended or adjusted under 35 U.S.C. 154(b) by 0 days.

(21) Appl. No.: 12/101,448

(22) Filed: Apr. 11, 2008

(65) Prior Publication Data

US 2009/0256402 A1 Oct. 15, 2009

(51) Int. Cl.
*A47C 1/02* (2006.01)

(52) U.S. Cl. ..... 297/68; 297/85 M; 297/85 L; 297/340; 297/362.11; 297/354.12

(58) Field of Classification Search ..... 297/354.12, 297/345.13, 68, 344.1, 344.11, 344.16, 344.17, 297/344.19, 344.2, 84–89, 340, 362.12–362.14
See application file for complete search history.

(56) References Cited

U.S. PATENT DOCUMENTS

| | | | | |
|---|---|---|---|---|
| 3,758,151 | A | 9/1973 | Re | |
| 3,858,932 | A | 1/1975 | Crum et al. | |
| 4,072,342 | A | 2/1978 | Johnson et al. | |
| 4,077,663 | A | 3/1978 | Cycowicz et al. | |
| 4,216,992 | A | 8/1980 | Crum | |
| 4,226,468 | A | 10/1980 | Johnson | |
| 4,367,895 | A * | 1/1983 | Pacitti et al. | 297/85 |
| 5,004,647 | A * | 4/1991 | Shah | 428/349 |
| 5,072,988 | A | 12/1991 | Plunk | |
| 5,120,107 | A * | 6/1992 | Rogers, Jr. | 297/68 |
| 5,348,367 | A * | 9/1994 | Mizelle | 297/83 |
| 5,823,614 | A | 10/1998 | Johnson et al. | |
| 6,032,976 | A * | 3/2000 | Dickie et al. | 280/650 |
| 6,135,554 | A * | 10/2000 | Tsun et al. | 297/327 |
| 6,227,489 | B1 * | 5/2001 | Kitamoto et al. | 244/118.5 |
| 6,357,776 | B1 * | 3/2002 | Goertzen et al. | 280/304.1 |
| 7,147,278 | B2 | 12/2006 | Johnson et al. | |
| 7,516,977 | B2 * | 4/2009 | Wu et al. | 280/650 |

FOREIGN PATENT DOCUMENTS

| | | |
|---|---|---|
| DE | 2629475 A1 | 2/1977 |
| EP | 1555005 A2 | 7/2005 |

OTHER PUBLICATIONS

Leggett & Platt "Adjustables" from a brochure.

* cited by examiner

*Primary Examiner*—David Dunn
*Assistant Examiner*—Erika Garrett
(74) *Attorney, Agent, or Firm*—Wolf, Greenfield & Sacks, P.C.

(57) ABSTRACT

A zero gravity wall hugger recliner having a motor drive, seat and backrest assembly that move back and forth on a trolley mounted on the chair base when the seat and backrest assembly move forward with the trolley on the chair base. A bracket attached between the base and seat moves the assembly from an upright to a reclined position. The recliner has a leg rest driven by a control bar attached between the leg rest and bracket for elevation the leg rest when the trolley moves forward and retracts the leg rest when the trolley moves to the rear.

7 Claims, 4 Drawing Sheets

ZERO GRAVITY WALL HUGGER RECLINER

BACKGROUND OF INVENTION

Field of Invention

This invention relates to reclining furniture and more particularly to zero gravity recliners. In accordance with this invention, the recliner includes one or more improvements directed to different features of the recliner.

SUMMARY OF INVENTION

In accordance with one aspect of the invention, the recliner is motor drive. In accordance with other aspects of the invention, the recliner is a wall-hugger allowing it to be placed close to the wall when in the upright position and without moving it away from the wall when reclined, has a zero gravity configuration when reclined supporting the legs of the occupant above the heart, and when the recliner is upright the leg rest retracts under the plan of the seat.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
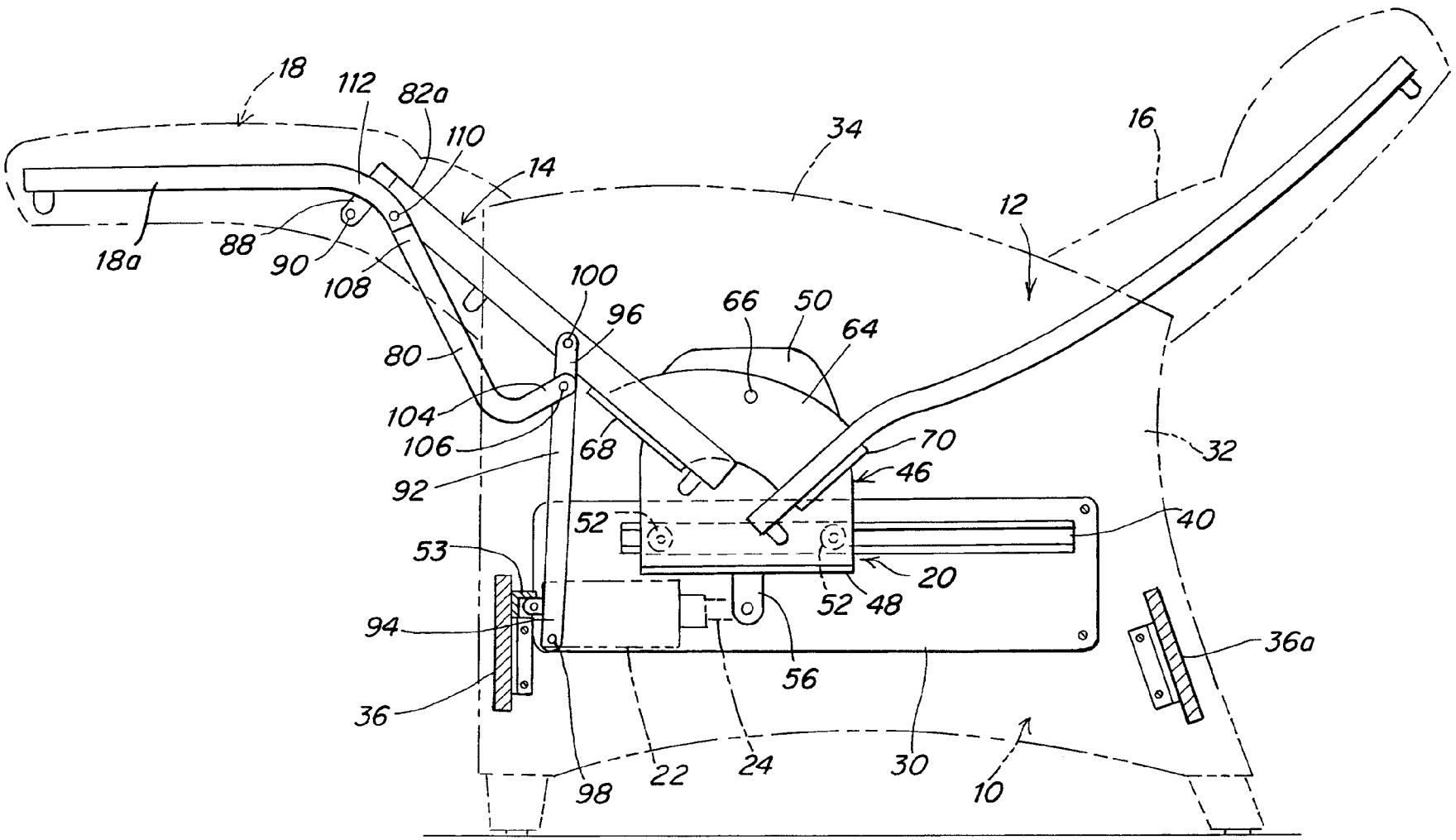
FIG. 1 is a vertical cross-sectional view of a zero gravity reclining chair in the reclined position, embodying the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The Zero Gravity Recliner of the present invention in the embodiment illustrated includes in its general organization a base 10 that carries the chair assembly 12 having a seat 14, backrest 16 and leg rest 18, the frame of the seat and backrest are identified as 14*a* and 16*a*. The chair assembly 12 is supported on the base by a motion assembly 20 that enables the chair assembly to move between zero gravity reclined and upright positions shown respectively in FIGS. 1 and 2. The motion assembly is driven by a motor 22 having a screw-type drive shaft 24 connected between the fixed base 10 and the motion assembly 20.

The base 10 in the embodiment illustrated includes a pair of side support panels 30, one on each side of the chair that extend fore and aft inside the frame sides 32 that define the chair arm rests 34. The side panels 32 are connected together by front and rear spreaders 36 and 36*a* to form a rigid frame, and each of the panels 30 mounted on the side walls 32 carries an essentially horizontal track 40 that extends front-to-back over a substantial portion of the length of the supports. While the tracks 40 shown are horizontal, in other embodiments they may be inclined and/or non-linear in shape.

Figure 3:
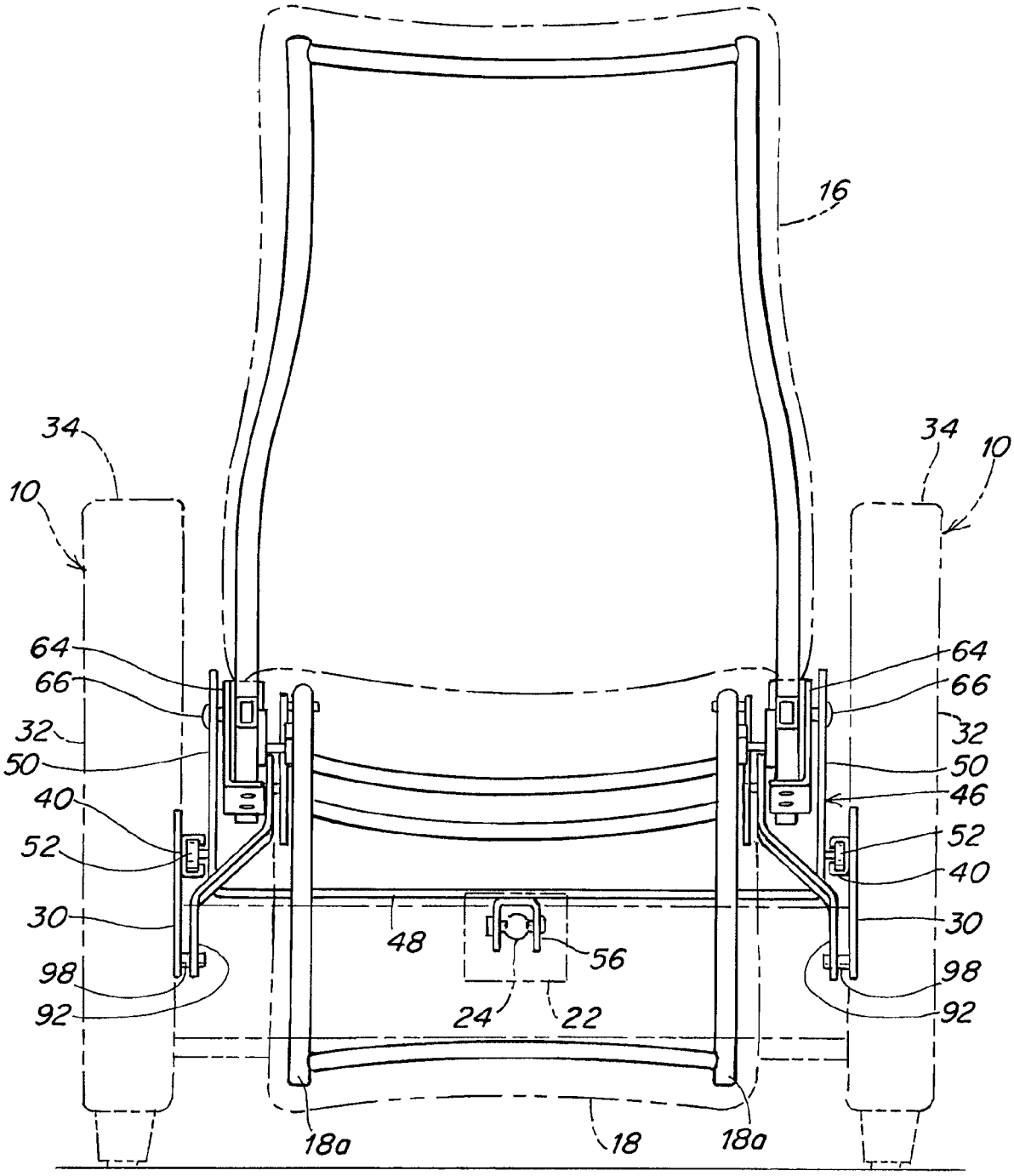
FIG. 3 is a rear elevation view of the chair in the upright position.

The chair assembly 12 is supported on the base 10 by a roller trolley 46 that may be generally U-shaped having a bottom plate 48 and side plates 50 (see FIG. 3). The bottom plate 48 and the side plates 50 may be a unitary structure either of one piece or of several pieces separately fabricated and secured together. Typically, the trolley 46 is made of metal but other materials may be used. Rollers 52 are mounted on the trolley side plates 50 so as to support the trolley for back-and-forth motion along the path defined by the tracks 40.

Figure 2:
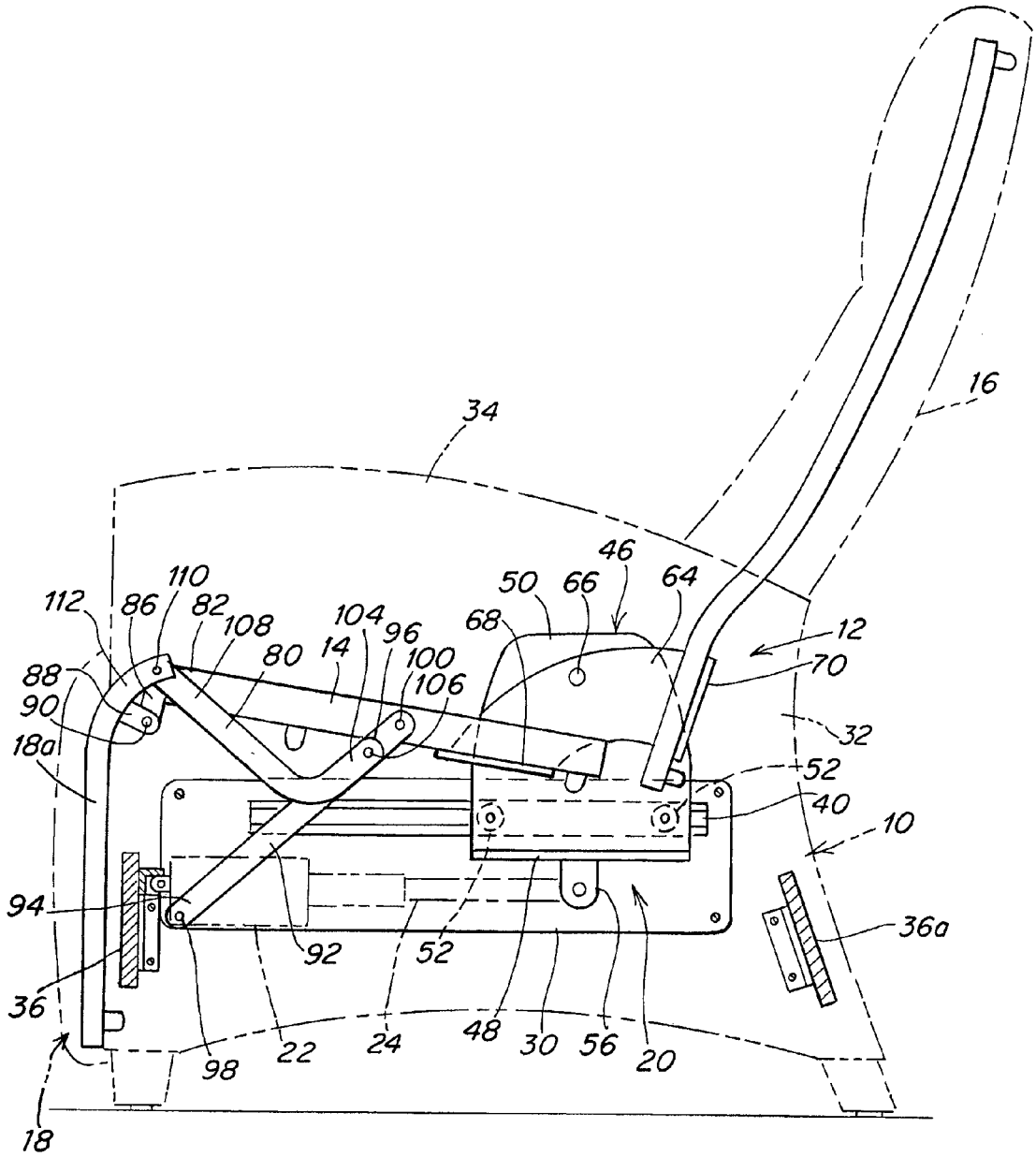
FIG. 2 is a cross-sectional view similar to FIG. 1 but showing the chair in the upright or sitting position.

As shown in FIGS. 1 and 2, the motor 22 is carried on a motor mount 53 attached to the front spreader 36, and its shaft 24 is attached to a bracket 56 connected to the bottom wall 48 of trolley 46. Because the bracket 56 is fixed to the trolley and the motor is fixed with respect to the base, rotation of the screw shaft 24 will move the trolley 46 back and forth on the tracks 40 determined by the rotational direction of the motor. While in the preferred embodiment illustrated, the motor 22 is mounted in a fixed location, for example, to the front spreader 36 of the frame and the free end of the screw shaft 24 is connected to the movable trolley 46, the assembly may be reversed so that the motor is attached to the rear spreader 36*a* or some other fixed location and the end of the screw shaft is attached to the trolley, in the direction opposite that shown. Alternatively, the motor 22 may be attached to the trolley 46 and the screw may be coupled to either of the spreaders or at another fixed location.

Each of the side plates 50 of the roller trolley 46 carries a motion bracket 64. The motion brackets 64 are pivotally connected to the side members 50 by pivot pins 66. The motion brackets 64 carry the seat frame 14*a* and backrest frame 16*a* on the bracket flanges 68 and 70 respectively, that are rigidly connected to the seat and backrest frames. In that fashion the frames of the seat and backrest are in a fixed angular relationship to one another that does not change when the two pivot as a rigid assembly with the motion brackets 46. By virtue of the attachment of the motion brackets to the roller trolley 46, the chair assembly 12 moves to and fro on the stationary base frame 10 (compare FIGS. 1 and 2).

The leg rest 18 as part of the chair assembly moves with the seat 14 and backrest 16, but its angular position is not fixed with respect to those chair parts. Rather, the leg rest 18 is pivotally mounted at the front end of the seat, and as explained in detail below, it pivots with respect to the seat by the action imparted to it by the leg rest control bars 80.

Figure 4:
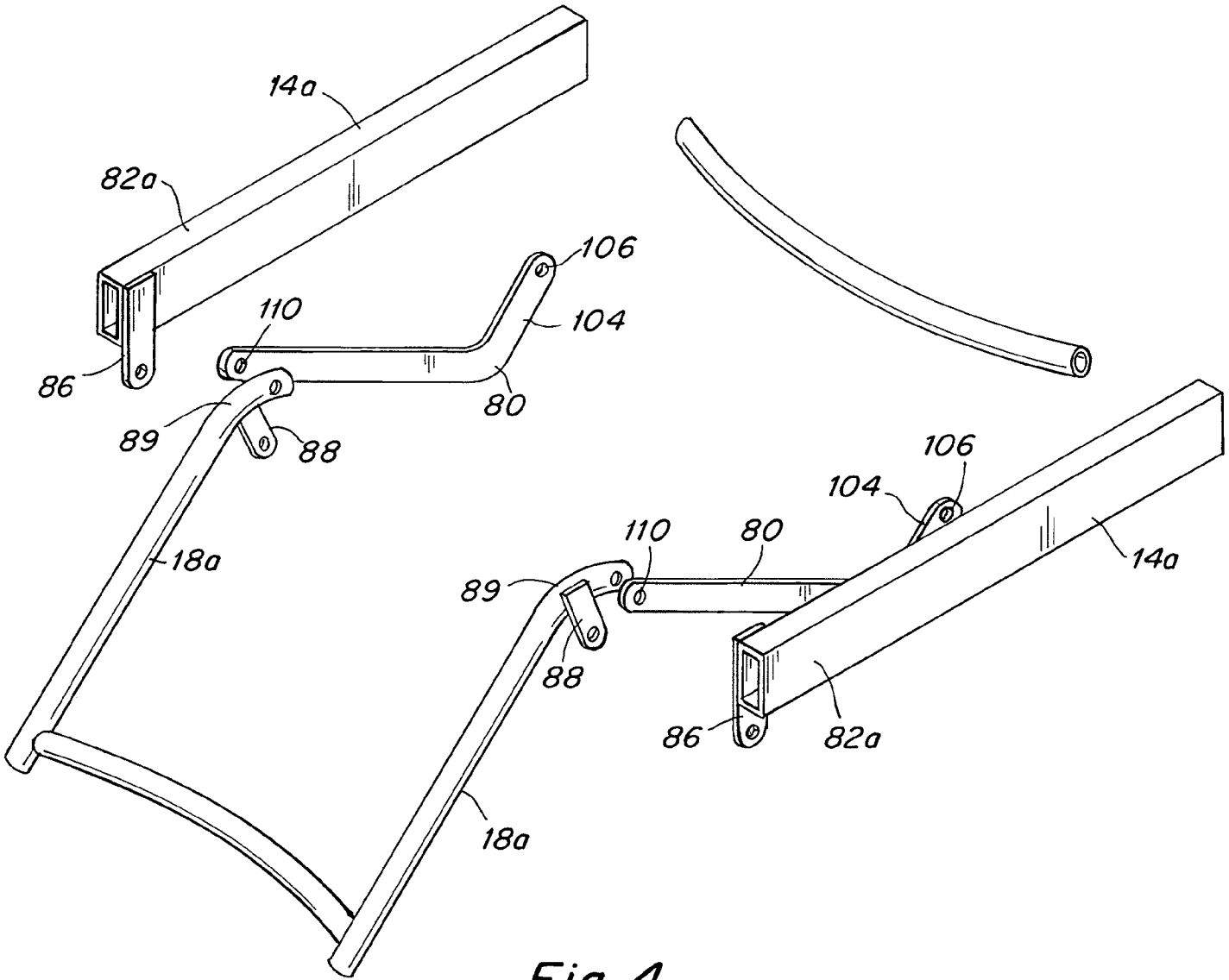
FIG. 4 is a fragmentary view of a portion of the reclining mechanism and particularly showing the mechanism for raising and lowering the leg rest.

As shown in FIG. 4, the front end 82*a* of each side of the seat frame 14 carries a bracket 86 that is pivotally connected to a pivot arm 88 fixed to the end 89 of the leg rest frame 18*a*. The two brackets are connected by pivot pin 90 to the pivot arms 88. This assembly is duplicated on each side of the leg rest. The leg rest control bars 80 on each side of the assembly are pivotally connected to the ends of the leg rest by pivots 110. The pivot 90 may be bolts, rivets or other well-known fastener. FIG. 4 shows a skeletal representation of the seat frame 14*a*, leg rest frame 18*a* and push bar 80 assembly along with brackets 86, pivot bars 88 and pivots 90. The leg rest frame 18*a* pivots on the seat by virtue of the connections of the brackets 86 and pivot arms 88 on each side of the assembly (compare FIGS. 1 and 2).

Pivotal motion of the unitized seat 14 and backrest 16 on the motion bracket 64 is imparted by actuating levers 92 pivotally mounted on each side of the seat at their lower ends 94 to fixed side supports 30 and at their upper ends 96 to the sides of the seat frame 14*a*. The connections of the ends 94 and 96 of the actuating levers 92 are provided by pivots 98 and 100. The side supports 30 establish fixed pivots 98 at the lower ends of actuating levers 92, and the upper pivots 100 move as the seat 14 moves with the trolley 46 and motion bracket 64. When the trolley moves in a forward direction on the tracks 40 (to the left as viewed in FIG. 2), the actuating levers 92 pivot upwardly to a more vertical position (compare FIGS. 1 and 2) about pivots 98 and elevate the seat 14 and tilt the backrest rearwardly to a reclined position.

Footrest control bars 80 that control the motion of the footrest with respect to the seat, are connected at one end 104 to the actuating levers 92 at pivot 106, and the other ends 108 of the control bars 80 are connected at pivot 110 to the end 112 of the footrest 18. When the actuating levers 92 move toward the vertical position as the trolley 46 moves forward on the tracks 40, the control bars 80 pivot the leg rest 18 about its pivots 90 on the brackets 86 causing the footrest to rise from the down or retracted position under the front edge of the seat 14 (see FIG. 2) to a horizontal position wherein the leg rest extends in a forward direction from the front edge of the seat to create a zero gravity support for the legs of the occupant of the chair above his/her heart (see FIG. 1).

From the foregoing description it will be appreciated that the combination of the moving trolley 46, actuating levers 92 and control bars 80 direct the recliner to its upright and reclined positions and simultaneously the leg rest to its retracted (FIG. 2) and zero gravity positions (FIG. 1) in response to operation of the motor. The motion of the trolley 46 moving the seat and backrest in a forward direction enable the recliner to be positioned very close to a wall behind the backrest so as to minimize the space required for the recliner in its upright position. The location of the recliner in proximity to a wall is in part determined by the height of the backrest and the thickness of its cushions, but spacing of the backrest just a few inches from a wall is sufficient to achieve the wall hugging effect. The mechanism enables the recliner to occupy a relatively small floor space as the leg rest is fully retracted when the recliner is upright, unlike most zero gravity furniture. It will also be appreciated that the motor powered mechanism may be used in other recliners that do not include retractable leg rests.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A zero gravity wall hugger recliner comprising a fixed base including a frame with side walls, a side panel connected to each side of the base and an essentially horizontal track mounted on each of the panels and oriented to extend front and back on said panels, a trolley mounted in the tracks and movable front to back on the track, a support pivotally carried on the trolley, a seat and a backrest mounted on the support in a fixed angular relationship to one another and pivotally movable as a unit on the trolley, a motor drive including a motor and link connected between the trolley and frame for moving the trolley front to back by the motor drive, a footrest mounted to the seat and pivotally movable with respect thereto between a reclined position and an upright position for supporting an occupant of the seat and backrest between an upright and zero gravity reclined position, an actuating lever connected between the seat and the frame causing the seat and backrest to move between an upright position when the roller trolley is in the rearmost position and a reclining position when the trolley is in a forward position on the frame, and a pull bar connected between the actuating lever and the footrest causing the footrest to pivot from a retracted position beneath the seat when the seat is in an upright position to a substantially horizontal elevated position in a plane at least as high as the front edge of the seat when the seat is in the reclining position.

2. The zero gravity wall hugger recliner recited in claim 1, wherein the support is pivotally carried on the trolley at a pivot point, wherein the pivot point is positioned above the seat.

3. A zero gravity recliner comprising a unitized seat assembly including a seat and backrest in a fixed angular relationship to one another and a leg rest pivotally connected to the seat, a fixed frame serving as the base of the recliner, essentially horizontal tracks mounted on and extending front to rear on the frame, a trolley mounted on the tracks and carrying the seat assembly for moving the seat assembly between a rearward and forward position on the frame, pivot plates pivotally supporting the seat assembly on the trolley at a pivot point enabling the seat assembly to move between an upright position and a zero gravity reclining position, wherein the pivot point is positioned above the seat, a motor drive connected to the trolley for moving the seat assembly between rearward and forward positions on the fixed frame, and actuating levers connected between the frame and the seat assembly for causing the seat assembly to move about the pivot point between an upright and fully reclined position and the leg rest to move between a retracted and zero gravity position when the trolley moves from a rearward to a forward position on the tracks.

4. A recliner comprising, a fixed chair frame having side panels that include a pair of arm rests, and cross members connecting the side panels together, a trolley movable back to front on the side panels, a seat and backrest assembly in fixed angular relationship with one another pivotally mounted as a unit on the trolley movable between reclining and upright positions, said assembly including a leg rest movable between a retracted and extended position with respect to the seat, a single motor drive connected to the trolley for moving the seat and backrest assembly forward and backward on the tracks, an actuating lever operatively connecting the frame and the seat for pivoting the assembly from an upright position when the trolley is in a rearward position to a reclining position when the trolley is in a forward position on the track, and a leg rest control bar directly connected to the actuating lever and the leg rest for moving the leg rest from a retracted position when the trolley is in a rearward position to an elevated position when the trolley is in a forward position on the track.

5. The recliner as set forth in claim 4 wherein the leg rest, when elevated, assumes a zero gravity position for supporting the legs above the heart of an occupant.

6. The recliner as set forth in claim 4 wherein the leg rest is pivotally mounted on the front of the seat adjacent the connection of the control bar to the seat.

7. The recliner recited in claim 4, wherein the seat and back rest assembly are pivotally mounted as a unit on the trolley at a pivot point which is positioned above the seat.

* * * * *